United States Patent [19]

Thaler

[11] Patent Number: 4,579,132

[45] Date of Patent: Apr. 1, 1986

[54] FLOCKED HAIR CURLING ROLLER

[75] Inventor: Arnold Thaler, Plantation, Fla.

[73] Assignee: Windmere Corporation, Hialeah, Fla.

[21] Appl. No.: 463,662

[22] Filed: Feb. 4, 1983

[51] Int. Cl.[4] ..... A45D 1/00

[52] U.S. Cl. ..... 132/39

[58] Field of Search ..... 132/39, 40, 42, 33 R, 132/33 G

[56] References Cited

U.S. PATENT DOCUMENTS

| | | | |
|---|---|---|---|
| 2,789,075 | 4/1957 | Stahl | 132/39 UX |
| 3,209,766 | 10/1965 | Dannat | 132/40 |
| 3,759,271 | 9/1973 | Caruso | 132/33 G |
| 3,888,266 | 6/1975 | Weldon | 132/39 |
| 4,282,360 | 5/1980 | Henry, Jr. | 132/40 |

*Primary Examiner*—Gregory E. McNeill

*Attorney, Agent, or Firm*—Odin, Feldman & Pittleman

[57] ABSTRACT

A hair curling roller with a flocked outer surface for curling the hair. The curling roller includes a central core member having an opening in one lateral end of the core member and longitudinally extending within the core member; this core member is formed of a material highly conductive of heat. A hollow sleeve member with a flocked outer surface is arranged on the core member. A first end ring is attached to the core member at one lateral end thereof; this first end ring has a flange extending over but spaced from the adjacent end portion of the flocked outer surface of the sleeve member. A second end ring having an attachment member is connected to the core member at the other lateral end thereof by the attachment; the second end ring has a flange extending over but spaced from the adjacent end portion of the flocked outer surface of the sleeve member. The first and second end rings are formed of a low heat conducting material. The attachment member has a prong mounted on an inner surface of the second end ring facing the core member. The prong is inserted into the opening in the core member for securing the second end ring to the core member. The diameter of the opening in the core member is dimensioned such that a heat conductive rod may be inserted into one end of the core member for transmitting heat to the roller. The flocking material is preferably formed from nylon with the preferred dimension of the strands of the nylon flocking material having a diameter of three denier and a length of 0.5 mm.

13 Claims, 5 Drawing Figures

FLOCKED HAIR CURLING ROLLER

BACKGROUND OF THE INVENTION

The invention relates to flocked hair curling rollers of the type which may be heated by the insertion of a cylindrical heating element within an interior cylindrical bore contained within the roller.

U.S. Pat. Nos. 3,888,266 to Weldon and 4,202,360 to Walter both disclose flocked hair curling rollers. The hair curler disclosed in U.S. Pat. No. 3,888,266 has a flocked outer surface having a large number of upstanding short non-hydroscopic filaments or fibers capable of retaining moisture by capillary action. The hair curling roller disclosed in U.S. Pat. No. b 4,202,360 has a cylindrical member having a flocked outer surface and a hollow cylindrical core which is adapted to receive a heating element. A pair of end caps are joined directly to the outside surface of the flocked roller at the ends of the cylinder. An inner cylindrical surface of each of the end caps directly engages the outer surface of the flocked roller and in order to secure such engagement, protrusions on such inner surface extend into recesses on the roller. The protrusions alternatively may be carried by either the end cap or the end of the flocked roller with the recesses being on the other member.

The flocked hair curling roller disclosed in U.S. Pat. No. 4,202,360 does not contain a space between the outside surface of the flocked roller and the inside surface of the end caps at the point of engagement of the end caps with the flocked roller. Because of the periodic heating and cooling of the roller during its use and storage, the end caps are subjected to periodic expansion and contraction which may cause structural fatigue of the end caps thereby potentially damaging them.

Moreover, the direct engagement of the inner surface of the end caps disclosed in U.S. Pat. No. 4,202,360 with the outer flocked surface of the roller can cause the flocking to be rubbed off the edge of the roller in the area of overlap between the end caps and the roller.

SUMMARY OF THE INVENTION

An object of the present invention is to provide an improved hair curling roller.

Another object of the present invention is to provide an improved flocked hair curling roller which creates a high heat transfer between a heating element disposed within a cylindrical bore within the roller and the exterior flocking carried on the outside surface of the roller.

A further object of the present invention is to provide a flocked hair curling roller which is not subject to structural fatigue caused by expansion and contraction between the end caps and the outside surface of the hair curling roller to which the end caps are joined.

It is a still further object of the present invention to provide a flocked hair curling roller in which the flocking carried on the outside surface of the hair curling roller in proximity to the ends thereof is not rubbed off by the attachment of end caps to the end of the hair curling roller.

A flocked hair curling roller in accordance with the invention includes a central core member having an opening in one lateral end of the core member and longitudinally extending within the core member and the core member being formed of a material highly conductive of heat; a hollow sleeve member arranged on the core member, the sleeve member having a flocked outer surface; a first end ring attached to the core member at one lateral end thereof, the first end ring having a flange extending over but spaced from the adjacent end portion of the flocked outer surface of the sleeve member; and a second end ring having an attachment member, the second end ring being connected to the core member at the other lateral end thereof by the attachment member, the second end ring having a flange extending over but spaced from the adjacent end portion of the flocked outer surface.

The opening in the core member extends through the core member from one lateral end surface to the other lateral end surface. The attachment member is a prong mounted on an inner surface of the second end ring facing the core member, and the prong is inserted into the opening in the core member for securing the second end ring to the core member. The portion of the opening at the end of the core member adjacent the second end ring is of a smaller diameter than the remainder of the opening extending through the core member. The prong has two parts formed of a resilient material within a space between the parts so that the parts can be squeezed together upon insertion of the prong into the opening in the core member and snapped back to their original position once the prong is inserted so as to secure the second end ring to the core member.

The first and second end rings are preferably formed of a material having low heat conducting properties. The first end ring has an opening which is aligned with the opening in the core member and is approximately of the same diameter as the opening in the core member. The opening in the core member is of a sufficient diameter and of sufficient length measured from the first end ring to permit the insertion of a heat conductive rod within the opening within the core member for a heat conductive rod for transmitting heat to the roller. The flocking material is preferably formed of nylon which has a diameter preferably of 3 denier and a length of 0.5 mm.

A flocked hair curling roller in accordance with the invention also may include a longitudinally extending cylindrical member having a flocked outer surface; a first end ring mounted at one end of the cylindrical member and having a flange extending over but spaced from the adjacent portion of the flocked outer surface of the cylindrical member; and a second end ring mounted at the opposite end of the cylindrical member, the second end ring having a flange extending over but spaced from the adjacent portion of the flocked outer surface of the cylindrical member. The cylindrical member is formed of a heat conductive material. The first and second end rings are formed of a material having low heat conductive properties. The flocking material is preferably formed of nylon which preferably has a diameter of 3 denier and a length of 0.5 mm.

DESCRIPTION OF THE PREFERRED EMBODIMENT

Figure 1:
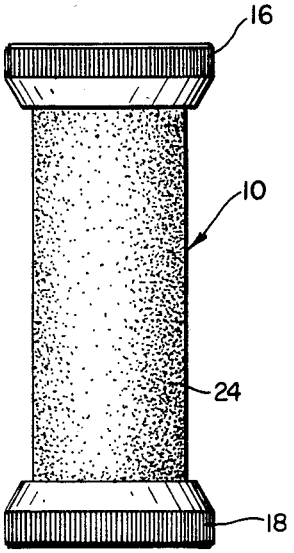
FIG. 1 is an elevational view of a flocked curling roller in accordance with the invention.
Figure 2:
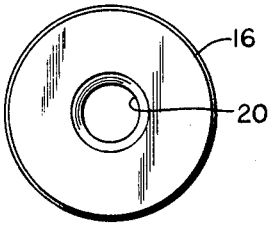
FIG. 2 is an end view of the flocked curling roller of FIG. 1.

A flocked curling roller 10, as shown in FIGS. 1 and 2, in accordance with the invention has a central core member 12, a hollow sleeve member 14, a first end ring 16 which is joined to one end of the central core member and a second end ring 18 which is joined to the other end of the central core member. The central core member has an opening 20 in one lateral end of the core member which opening extends longitudinally within the core member. The core member 12 is formed of a material which is highly conductive of heat such as a metal or a filled plastic.

The hollow sleeve member 14 is located with respect to the central core member such that the inner surface of the hollow sleeve is in surface contact with the outer surface of the central core member. The outside surface 22 of the hollow sleeve member is flocked with a material which has good heat conductive properties.

Figure 4:
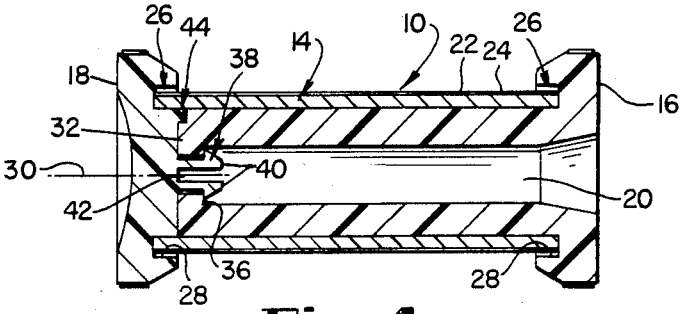
FIG. 4 is a sectional view of the flocked curling roller of FIG. 1.

The first end ring 16 and the second end ring 18 each have an annular recess 26 which has an outside surface 28. The diameter of outside surface 28 of recess 26 measured from the longitudinal axis that is greater than the diameter of the outside surface 22 of the hollow sleeve member 14 to which the flocking 24 is applied as can be seen from FIG. 4. The central core member 12 has an end 32 having a opening 34 having a diameter smaller than the opening 20 disposed in the other end of the central core member. The diameter of the cylindrical hull within the central core member 12 reduces from that of opening 20 to that of opening 34 in proximity to the end 32 to form a surface 36 which engages an attachment member 38 which is disposed in the center of the second end ring 18.

The attachment member 38 on end ring 18 is made from a resilient material which has a memory for assuming its original shape such as plastic. The attachment member, which functions as a prong, has two parts 40 which are separated by a space. The attachment member is used to fixedly engage the second end ring 18 within the end 32 of the core member 12. When the attachment member 40 is inserted within the opening 34, the parts 40 are pushed together so that they may clear the reduced diameter of the opening. After the outwardly tapered portions of the parts 40 have cleared the opening 34, they spring back to their original position which causes their engagement with the surfaces 36 to lock the end ring 18 longitudinally in place within the end 32 of the central core member 12.

Rotation of the second end ring 18 is prevented by a locking means 44 formed by a projection 46 which engages recess 48. The function of the locking means is to prevent rotation of the first and second end rings with respect to the flocked surface around which the hair of the user is wrapped.

The end rings 16 and 18 are manufactured from a material, such as plastic, which has a low coefficient of heat conduction. The low coefficient of heat conduction of the end rings 16 and 18 prevents the user from being burned while wrapping hair around the flocked outside surface 22 which is designed to be heated to high temperature by the insertion of a heating element within the opening 20 of the central core member. A heating element has not been illustrated in the drawings for the sake of clarity since the use of insertable heating elements within the center of hair rollers is known.

The location of surface 28 of the second end ring 18 so that it is not in surface contact with the flocking 24 of the outside surface 22 of the hollow sleeve member 14 but is spaced from such surface provides several advantages. In the first place, the expansion and contraction of the diameter of the hollow sleeve member consequent from repeated heating and cooling cycles does not cause strain on the outside surface 28. Accordingly, with the arrangement of the present invention there is no possibility of expansion-contraction stress failure on the end caps which is possible with the flocked hair curling roller illustrated in U.S. Pat. No. 4,202,360. Second, since there is no surface contact between the flocking 24 and the surface 28, the flocking is not worn or damaged by the attachment of the second end ring 18 to the central core member 12.

Figure 5:
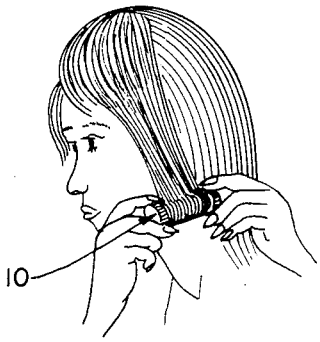
FIG. 5 is a view illustrating the use of the flocked curling roller of the present invention.
Figure 3:
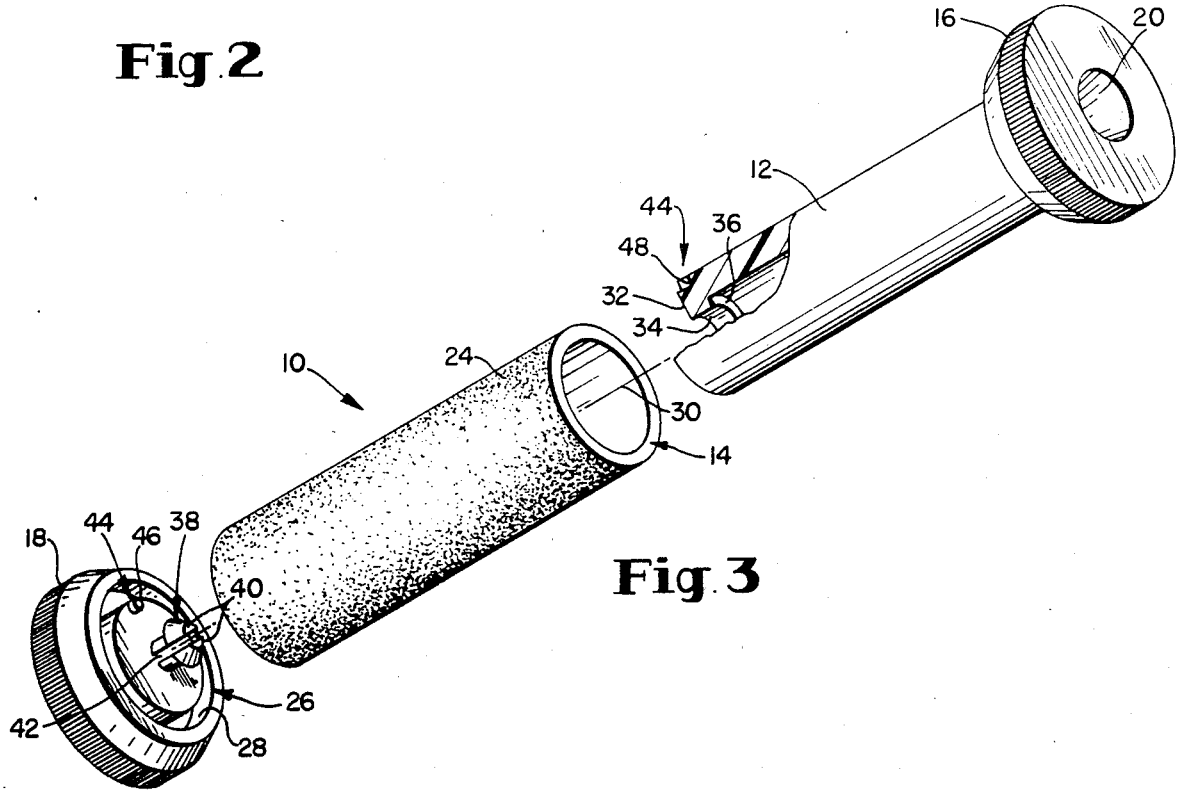
FIG. 3 is an exploded isometric view of a flocked curling roller in accordance with the invention.

Preferably, the flocking 24 is nylon fiber having a diameter of approximately 3 denier and a length of approximately 0.5 mm. The flocking provides a large surface area which contacts the hair which is rolled around the outside surface of the central core member by a user such as shown in FIG. 5. The large surface area of the flocking permits efficient heat transfer between the hollow sleeve member 14 and the hair which is wrapped around the outside surface 22 in contact with the flocking 24. The flocking should be glued to the outside surface of the hollow sleeve member with any adhesive which is resistant to moisture and various commercial products which are used by women for setting and conditioning hair. The choice of adhesive used for attaching the flocking 24 to the outside surface 22 of the hollow sleeve member 14 and the method of application of the flocking to the outside surface of the hollow sleeve member do not form part of the present invention. Both adhesives and the method of attaching flocking are known to those persons skilled in the art.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A roller for curling hair comprising:

(a) a central core member having an opening in one lateral end of said core member and extending longitudinally within said core member from one lateral end surface to the other lateral end surface and said core member being formed of a material highly conductive of heat;

(b) a hollow sleeve member separate from said core member and arranged on said core member, said sleeve member having a flocked outer surface;

(c) a first end ring formed of a low heat conducting material and attached to said core member at one lateral end thereof, said first end ring having a flange extending over but having its inner surfaces spaced away from the adjacent end portion of said flocked outer surface of said sleeve member; and, (d) a second end ring formed of a low heat conducting material and having an attachment member, said second end ring being connected to said core member at the other lateral end thereof by said attachment member, said second end ring having a flange extending over but having its inner surfaces spaced away from the adjacent end portion of said flocked outer surface of said sleeve member.

2. A roller according to claim 1 wherein said opening in said core member extends through said core member from one lateral end surface to the other lateral end surface, said attachment member is a prong mounted on an inner surface of said second end ring facing said core member, and said prong is inserted into said opening in said core member for securing said second end ring to said core member.

3. A roller according to claim 2 wherein the portion of said opening at the end of said core member adjacent said second end ring is of a smaller diameter than the remainder of said opening extending through said core member.

4. A roller according to claim 3 wherein said prong has two parts formed of a resilient material with a space between said parts so that said parts can be squeezed together upon insertion of said prong into said opening in said core member and will snap back to their original position once said prong is inserted so as to secure said second end ring to said core member.

5. A roller according to claim 4 wherein both said first and second end rings are formed of a material having low heat conducting properties.

6. A roller according to claim 4 wherein said first end ring has an opening therein, such opening in said first end member is aligned with said opening in said core member and is approximately of the same diameter as said opening in said core member.

7. A roller according to claim 6 wherein said remainder of said opening in said core member is of a sufficient diameter and extends for a sufficient length from said first end ring to enable said roller to be arranged on a heat conductive rod for transmitting heat to said roller.

8. A roller according to claim 1 wherein said flocking material is formed of a nylon material.

9. A roller according to claim 8 wherein the strands of said nylon flocking material have a diameter of 3 denier and a length of 0.5 mm.

10. A roller for curling hair comprising:

(a) a central core member having an opening in one lateral end of said core member and extending longitudinally within said core member from one lateral end surface to the other lateral end surface and said core member being formed of a material highly conductive of heat;

(b) a longitudinally extending cylindrical member arranged on said core member, said cylindrical member having a flocked outer surface;

(c) a first end ring formed of a low heat conducting material and arranged at one end of said core member so as to be connected to said core member and having a flange extending over but spaced away from the adjacent portion of the flocked outer surface of said cylindrical member; and, (d) a second end ring formed of a low heat conducting material and having an attachment member and being mounted at the opposite end of said core member, said second end ring having a flange extending over but spaced away from the adjacent portion of said flocked outer surface of said cylindrical member, said attachment member is a prong mounted on an inner surface of said second end ring facing said core member and said prong is inserted into said opening in said core member for securing said second ring to said core member.

11. A roller according to claim 10 wherein said core member is formed of a highly heat conductive material.

12. A roller according to claim 11 wherein said flocking material is formed of a nylon material.

13. A roller according to claim 12 wherein the strands of said nylon flocking material have a diameter of 3 denier and a length of 0.5 m.

* * * * *